United States Patent [19]

Guinon

[11] Patent Number: 4,979,392

[45] Date of Patent: Dec. 25, 1990

[54] RAILROAD TRACK FAULT DETECTOR

[75] Inventor: Walter J. Guinon, Newburyport, Mass.

[73] Assignee: The Charles Stark Draper Laboratory, Inc., Cambridge, Mass.

[21] Appl. No.: 433,129

[22] Filed: Nov. 8, 1989

[51] Int. Cl.[5] ..... B61L 1/20

[52] U.S. Cl. ..... 73/146; 246/34 R; 246/121

[58] Field of Search ..... 73/146; 246/121, 122 R, 246/34 R, 34 B, 169 R, 34 CT; 364/561, 507; 33/1 Q, 523.2; 340/933

[56] References Cited

U.S. PATENT DOCUMENTS

| | | | |
|---|---|---|---|
| 2,672,753 | 3/1954 | Drake | 73/146 |
| 3,387,064 | 6/1968 | Joy et al. | 246/34 R |
| 3,392,451 | 7/1968 | Lombardo | 73/146 |
| 3,891,167 | 6/1975 | Perry | 246/34 R |
| 4,005,601 | 2/1977 | Botello | 73/146 |
| 4,026,505 | 5/1977 | Geiger et al. | 246/34 R |
| 4,117,529 | 9/1978 | Stark et al. | 246/34 R |
| 4,145,018 | 3/1979 | Poggio et al. | 246/34 R |
| 4,306,694 | 12/1981 | Kuhn | 246/34 R |
| 4,322,772 | 3/1982 | Fry | 361/111 |
| 4,325,524 | 4/1982 | Krug | 246/34 R |
| 4,389,033 | 6/1983 | Hardman | 246/37 |
| 4,403,410 | 9/1983 | Robinson | 29/830 |
| 4,422,336 | 12/1983 | Beebe | 73/146 |
| 4,432,517 | 2/1984 | Ripamonti | 246/28 F |
| 4,445,085 | 4/1984 | Metcalf et al. | 324/52 |
| 4,471,929 | 9/1984 | Rhoton et al. | 246/182 R |
| 4,886,226 | 12/1989 | Frielinghaus | 246/34 R |

*Primary Examiner*—Joseph A. Orsino
*Assistant Examiner*—Brent A. Swarthout
*Attorney, Agent, or Firm*—Weingarten, Schurgin, Gagnebin & Hayes

[57] ABSTRACT

A railroad track fault detector is mounted on a tracked vehicle and uses the track ahead or behind the vehicle as a transmission line for a high frequency signal. The transmission line has a known characteristic impedance in a condition of no track fault. The impedance is included in a bridge network that is excited with the high frequency signal. Bridge imbalance is detected as an indication of a track fault that can be a complete or partial short circuit or open circuit. The bridge excitation is applied to the track through moving contacts like brushes ahead of the front wheels or behind the last wheels. The shunt effect of wheels close to the brushes is eliminated by a tuning impedance that creates an effective infinite impedance to the portion of the track between the moving contacts and the shunting wheels.

14 Claims, 1 Drawing Sheet

RAILROAD TRACK FAULT DETECTOR

FIELD AND BACKGROUND OF THE INVENTION

In the modern world of high speed rail travel with welded rails and in the increasing reliance on rail transport in the metropolitan corridor, rail condition becomes an increasingly important safety concern. Rail faults can occur as a break in the rail or as a fouling of the rails such as resulting from an object lying across one or both rails. Such faults can occur between the passage of trains and go undetected, particularly on long and winding runs or when operator attention may be diminished.

Various schemes are known to transmit signals along a railroad track by simple electrical conduction not dependent on transmission line characteristics for signaling or other purposes. In such instances rail integrity may correlate with the conductivity between rails. Such conductivity cannot then be used as a reliable indicator of the track condition for load carrying purposes.

In addition a track fault may develop or be more detectable during the loading when a train passes over the rails. It would be advantageous to be able to detect failure in this condition as well.

BRIEF SUMMARY OF THE INVENTION

According to the teaching of the present invention, a rail condition detector is provided using the railroad rails as a transmission line having a characteristic impedance. This impedance is included in one leg of a bridge that is excited with a high frequency signal appropriate to propagate a signal down the rails of a track a distance great enough to provide an opportunity for a train operator to detect a track fault ahead in time to take corrective action. The track impedance for a normal rail condition balances the bridge so that the bridge output terminals contain no signal. When a track fault occurs along the line, the rail transmission line impedance changes and unbalances the bridge so that the unbalanced condition can be detected at the output terminals. The degree of unbalance and the resulting magnitude of the bridge output is a reflection of the distance away that the fault lies. The bridge output will have a frequency doppler shifted from the original excitation frequency by an amount indicative of vehicle speed.

A track fault, occurring or becoming more detectable as the train passes over the failing rail is detected by a similar system located behind the last car so that subsequent traffic over that section of track can be alerted or repairs made before the next train.

Since the detector is designed for mounting on a moving vehicle such as a train, the rail transmission line impedance is connected into the bridge through moving contacts or brushes located ahead of the vehicle frontmost wheel pair to detect track faults ahead and/or behind the last or rear-most wheel pair of the vehicle to detect track faults behind. The wheel pair closest to the brushes are a shunt to the transmission line. This is balanced out by a tuning impedance connected across the tracks between the bridge contacts and the closest shunting wheel pair. This balasting impedance is selected to give, in combination with the wheel shunt, the appearance of an open or infinite impedance to the portion of the track between the bridge contacts and the shunting wheel pair.

BRIEF DESCRIPTION OF THE DRAWING

These and other features of the invention are more fully illustrated in the solely exemplary detailed description below and in the accompanying drawing of which.

DETAILED DESCRIPTION

The present invention contemplates the detection of railroad track faults by sensing the transmission line response of a pair of rails excited by a high frequency signal.

Figure 1:
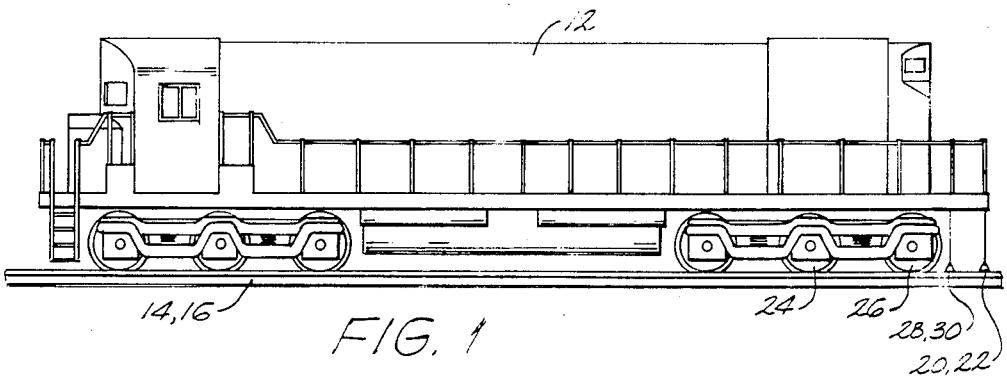
FIG. 1 is a pictorial diagram of a tracked vehicle having contacts of a fault detector of the present invention located ahead of front wheels of the vehicle.
Figure 1A:
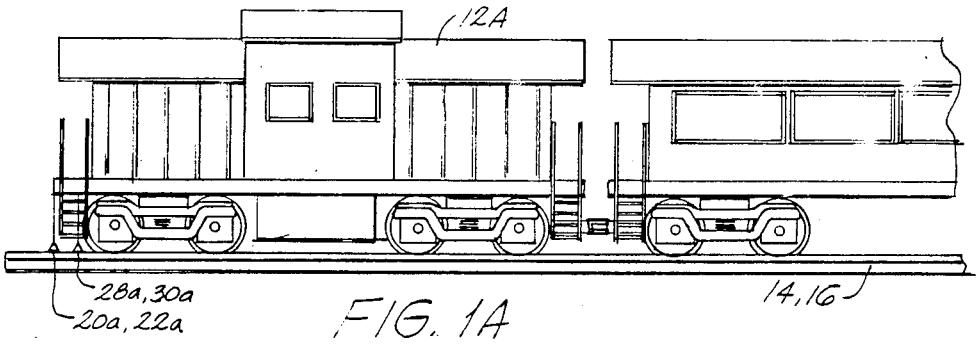
FIG. 1A is a pictorial diagram of the tracked vehicle having contacts of the fault detector of the present invention located behind the last wheels of the vehicle.
Figure 2:
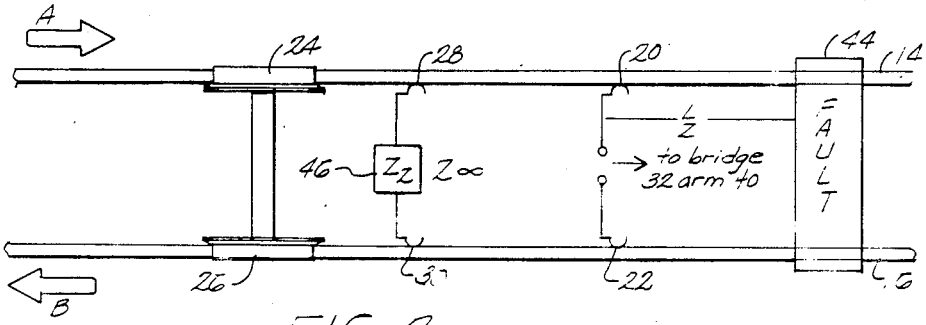
FIG. 2 is a diagram of the general electrical components of the invention.

The invention is particularly suitable for use in train systems of the type illustrated in FIGS. 1, 1A and 2. As shown in FIGS. 1 and 2, a train 12 is placed upon a pair of rails 14, 16 of a track for travel in the conventional manner. A fault detector according to the present invention is located at the front of the vehicle. A pair of moving contacts or brushes 20, 22 contact each of the pair of rails 14, 16 to apply high frequency excitation, from instrumentation located on board the train 12, along the rails ahead of the train which function as a transmission line.

As viewed in FIG. 1A, a last car of a train **12*a* is placed upon the pair of rails 14, 16 of a track for travel in the conventional manner. A fault detector according to the present invention is located at the rear of the last vehicle. A pair of moving contacts or brushes 20*a*, 22*a* contact each of the pair of rails 14, 16 to apply high frequency excitation, from instrumentation located on board the train 12*a***, along the rails behind the train which function as a transmission line.

Referring now to FIG. 2, the train 12 or **12*a* rolls on a set of wheels 24, 26 which represent a pair of frontmost wheels if the fault detector is located at the front of the train travelling in the direction of arrow A, or which represent a pair of rear-most wheels if the fault detector is located at the rear of the train travelling in the direction of arrow B. Wheels 24, 26 act to electrically shunt the rails 14 and 16. To prevent this from affecting the detection of track faults in front of or behind the train 12 or 12*a*, a second set of brushes 28, 30 contact the rails 14, 16 between brushes 20, 22 and wheels 24, 26** to apply a tuning impedance that counteracts the shunt effect of the wheels as explained below.

Figure 3:
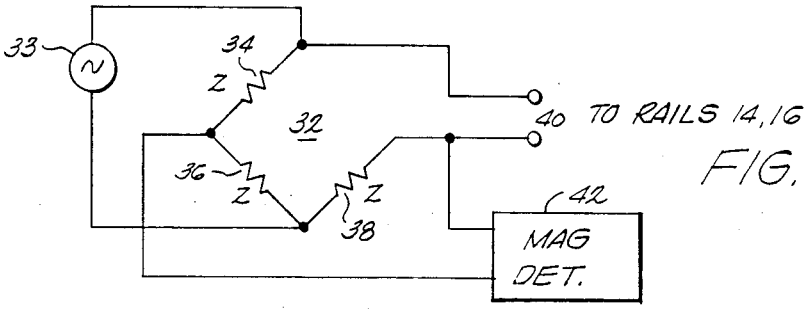
FIG. 3 is a circuit diagram of the bridge and detection scheme of the present invention.

The rails 14, 16 exhibit a characteristic impedance $Z_c$ which is about 300 ohms with no fault. As illustrated in FIG. 3 a bridge 32 is excited from a high frequency excitation source 33 at a frequency sufficiently high to permit useful signals to be transmitted along the rails. The bridge 32 has three equal arms 34, 36, 38 of impedance Z, the no fault characteristic impedance. Each of the rails 14, 16 are connected into the bridge as the fourth arm 40. A detector 42 is connected across the output terminals of the bridge, opposite from the excitation input terminals. The detector detects the magnitude of the output signal as an indication of the distance from the train 12 to a fault 44 along the rails 14, 16.

In the case where the fault is a short circuit or other fouling at a distance $\sigma$ from the train 12, the rails' characteristic impedance becomes:

$$Z_c = Z \tanh \gamma\sigma$$

where $\gamma$ is the complex propagation constant of the rails. In the case of an open circuit or broken line, the impedance seen by the bridge is:

$$Z_c = Z \coth \gamma\sigma$$

When the bridge is excited by a signal of $V\sin(\omega t)$, the output of the bridge is:

$$(V/4Z)(Z_c - Z) \sin(\omega t).$$

With rail transmission line attenuation large and thus:

$$|e^{-2\gamma\sigma}| << 1$$

the output of the bridge is:

$$V \cdot e^{(-2\gamma\sigma)} \sin(\omega t).$$

When the train is moving at a constant velocity, v, such that $\sigma = L - vt$, where L is the distance to a fault at the start of the measurement, the output becomes:

$$V \cdot e^{-2\alpha(L-vt) - j2/\lambda - j2vt/\lambda} \sin(\omega t)$$

where $\alpha$ is the real part of $\gamma$ and $\lambda$ is the imaginary part.

When there is no fault the bridge outPut is zero. In the presence of a fault, the bridge will have a doppler shifted output corresponding to the train speed at a magnitude of:

$$V \cdot e^{-2\alpha L}.$$

The bridge output in the presence of a fault will be attenuated as a function of the distance to the fault, $e^{-2\alpha L}$, so the signal strength, or signal to noise ratio, must be sufficient to overcome this attenuation.

The compensating impedance 46, $Z_z$, applied across the brushes 28, 30 is selected to compensate for the shunt effect of the wheels 24, 26. In effect the short of the wheels 24, 26 transforms to a complex impedance at the location of the brushes 28, 30. To compensate for this impedance, the impedance 46 resonates with this transformed impedance, creating an infinite back impedance to the transmission line of rails 14, 16.

The thus described rail fault detection system provides an effective rail condition analyzer to enhance rail safety. The features of the invention may be realized by other means than those shown and accordingly the invention is limited only as claimed below.

I claim:

1. A dual rail fault location system comprising:

a vehicle adapted for motion along a pair of rails, said vehicle having a plurality of wheels adapted for traveling along the rails;

means positioned on said vehicle for exciting said pair of vehicle rails on which said vehicle is adapted to travel at points of excitation on said rails with a traveling wave, said pair of rails functioning as a two wire transmission line;

means for detecting a transmission line impedance condition of said pair of rails to said travelling wave representative of a conductivity aberation along said rails;

means for masking shunt effects along said pair of rails in a direction toward the vehicle wheels and away from said points of excitation.

2. The system of claim 1 wherein said exciting means includes an oscillator and a bridge of impedances with one impedance of the bridge comprising the transmission line formed by the pair of rails.

3. The system of claim 1 wherein said masking means includes means for applying an impedance across said pair of rails at a location between said vehicle wheels and said points of excitation to said pair of rails to compensate for rail to rail conduction caused by said wheels.

4. The system of claim 2 wherein said pair of rails are connected into said bridge through moving contacts.

5. The system of claim 2 wherein said detecting means includes means for detecting the magnitude of bridge imbalance as an indication of the existence and location of a rail fault.

6. The system of claim 4 wherein said moving contacts are located ahead of a front-most pair of vehicle wheels.

7. The system of claim 6 wherein said masking means is located between said front-most vehicle wheels and said moving contacts.

8. The system of claim 4 wherein said moving contacts are located behind a rear-most pair of vehicle wheels.

9. The system of claim 8 wherein said masking means is located between said rear-most vehicle wheels and said moving contacts.

10. A dual rail fault location system comprising:

a vehicle adapted for motion along a pair of rails, said vehicle having a plurality of wheels adapted for traveling along said rails, said plurality of wheels including a front-most wheel pair and a rear-most wheel pair;

a plurality of means positioned on said vehicle for exciting said pair of vehicle rails on which said vehicle is adapted to travel with traveling waves, at least one of said plurality of means for exciting said pair of vehicle rails being located proximate to said front-most wheel pair and at least one of said plurality of means for exciting said pair of vehicle rails being located proximate to said rear-most wheel pair;

means for detecting a transmission line impedance condition of said pair of rails to said travelling waves representative of a conductivity aberation along said rails in a forward direction of travel and in a direction opposite said forward direction of travel;

means for masking shunt effects along said pair of rails, in a direction away from said forward direction of travel and toward said front-most wheel pair, and in a direction away from said direction opposite said forward direction of travel and toward said rear-most wheel pair.

11. The system of claim 10 wherein said means for exciting includes at least one oscillator and at least one bridge of impedances with one impedance of said bridge comprising a transmission line formed by said pair of rails.

12. The system of claim 10 wherein said masking means includes means for applying first and second impedances across said pair of rails at locations between said front-most and rear-most wheel pairs and points of application of excitation to said pair of rails respectively to compensate for rail to rail conduction caused by said wheel pair.

13. The system of claim 11 wherein said pair of rails are connected into said bridge through moving contacts.

14. The system of claim 11 wherein said detecting means includes means for detecting the magnitude of a bridge imbalance as an indication of the existence and location of a rail fault.

* * * * *